United States Patent [19]

Kretchman et al.

[11] 4,265,100

[45] May 5, 1981

[54] PIVOTAL SIPHON BLEACH DISPENSER FOR AUTOMATIC WASHER

[75] Inventors: Gerald L. Kretchman, St. Joseph; James R. Mulder, Berrien Township, Berrien County; John W. Pielemeier, St. Joseph, all of Mich.

[73] Assignee: Whirlpool Corporation, Benton Harbor, Mich.

[21] Appl. No.: 111,714

[22] Filed: Jan. 14, 1980

[51] Int. Cl.[3] ..... D06F 39/02

[52] U.S. Cl. ..... 68/12 R; 68/17 R; 68/207; 134/58 D; 134/93; 134/100

[58] Field of Search ..... 68/12 R, 17 R, 207; 134/57 D, 58 D, 93, 95, 100; 137/132; 141/124, 323

[56] References Cited

U.S. PATENT DOCUMENTS

| | | | |
|---|---|---|---|
| 2,699,886 | 1/1955 | James | 68/17 R X |
| 2,711,178 | 6/1955 | Sharp et al. | 134/100 X |
| 2,887,862 | 5/1959 | Jennings | 68/12 R |
| 2,974,516 | 3/1961 | Finley et al. | 68/207 |
| 3,057,181 | 10/1962 | Goodlaxson | 68/207 |

FOREIGN PATENT DOCUMENTS

| | | | |
|---|---|---|---|
| 2401259 | 4/1979 | France | 68/17 R |

*Primary Examiner*—Philip R. Coe

*Attorney, Agent, or Firm*—Hill, Van Santen, Steadman, Chiara & Simpson

[57] ABSTRACT

A laundry additive dispenser for use with laundry appliances has a tiltable bin pivotally mounted for user access on a panel of the laundry appliance. The bin is divided into three sections which are exposed when the bin is tilted forward to a receiving position and may be filled with liquid or granular laundry additives. The bin is then tilted back to a dispensing position. The sections of the bin for dispensing liquid laundry additives each have a siphon therein. Solenoid operated valves selectively communicate each section with a water distribution path. When an appropriate valve is opened water flows in the proper section of the bin and when the water-additive solution reaches an appropriate level, siphoning action begins and the entire contents of the section is dispensed to a clothes treatment zone in the appliance. Each section is provided with an overflow tube to insure that the liquid level in the section does not reach a level so as to prevent the siphoning action.

9 Claims, 8 Drawing Figures

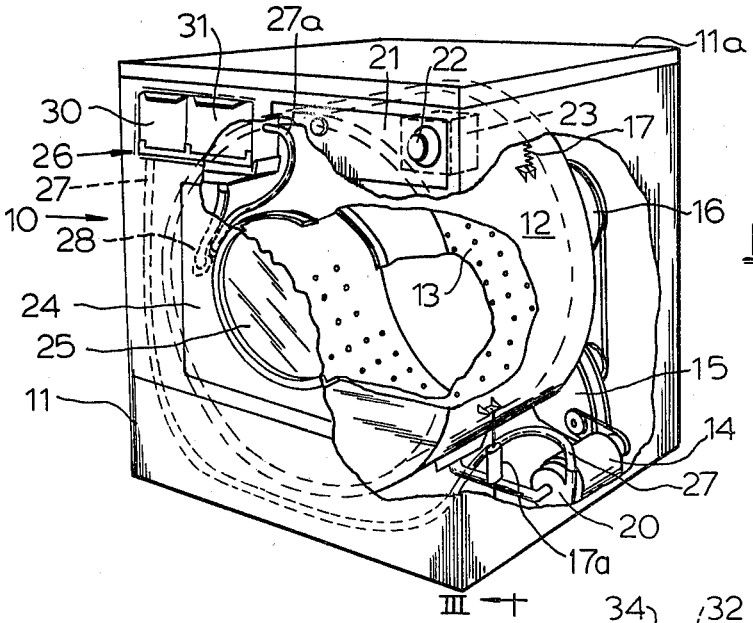
FIG. 1
FIG. 2
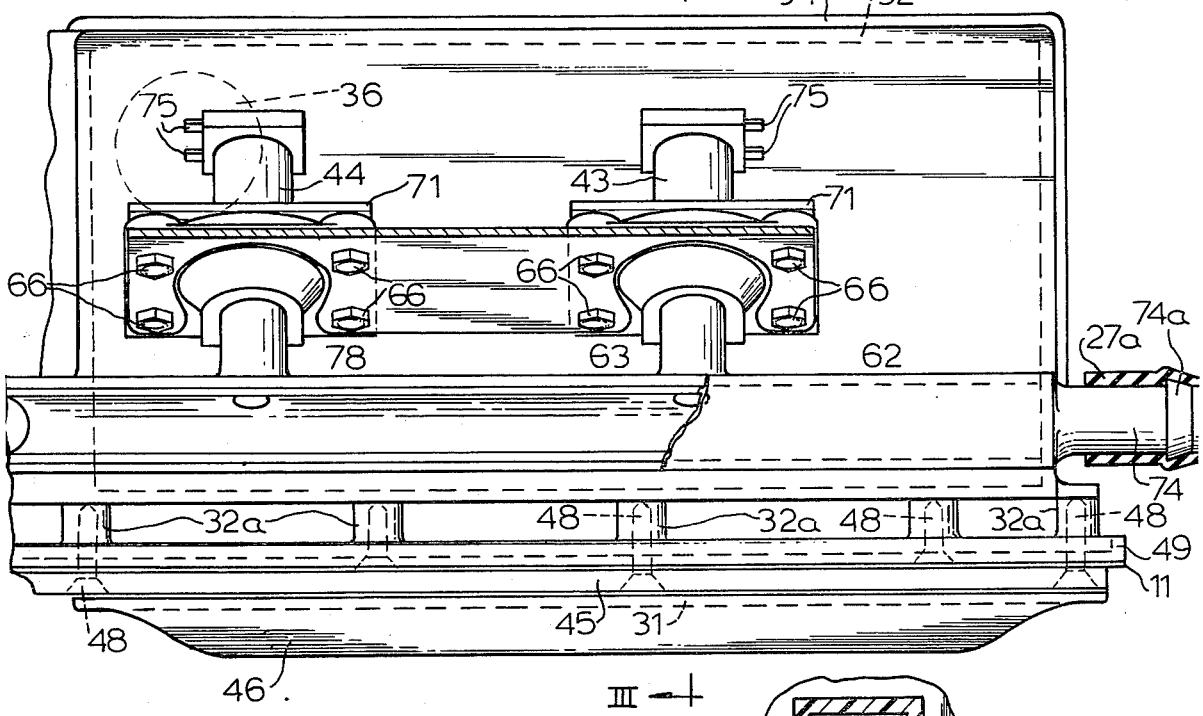
FIG. 5
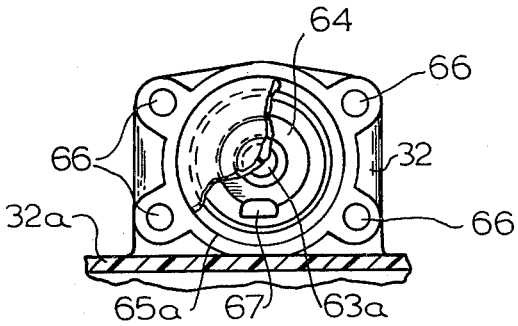
FIG. 7
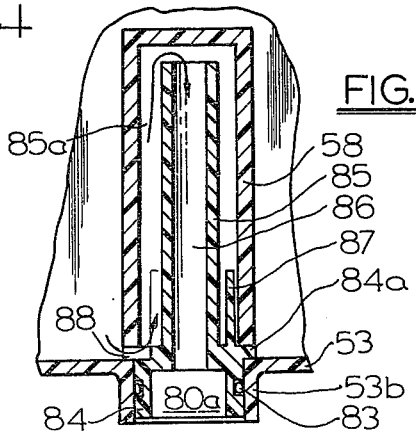

PIVOTAL SIPHON BLEACH DISPENSER FOR AUTOMATIC WASHER

BACKGROUND OF THE INVENTION

1. Field of the Invention

The present invention relates to laundry additive dispensers, and in particular to such dispensers employing siphoning action in combination with solenoid operated valves to selectively dispense a number of additives to a laundry appliance.

2. Description of the Prior Art

Effective clothes treatment in domestic laundry appliances frequently requires the addition of additives other than a cleaning agent to the clothes treatment solution. Additives such as fabric softener, water softener' bleach and the like may be necessary depending upon local water conditions and the nature of the clothes to be treated. Laundry appliances known in the art generally complete a cycle of operation including a wash or agitation portion, a spin portion to centrifugally extract the wash liquid, a rinse portion, and a final liquid extraction spin portion. A problem in the art has been providing a laundry additive dispenser which automatically dispenses appropriate laundry additives at selected times during a cycle of operation coordinated with the particular portion of the cycle in which the additive can be most effectively utilized. Thus it is normally desirable to dispense the detergent and bleach into a wash portion of the cycle, while on the other hand it is preferable to delay dispensing of a fabric softener until a later portion of the cycle.

Devices for dispensing a single laundry additive at a selected time during a cycle of operation are known in the art, such as those disclosed in U.S. Pat. Nos. 3,057,181, 2,974,516 and 2,887,862. The first and last of these patents utilize a siphon contained in the dispenser to dispense a water-additive solution into a clothes treatment area when a solution level in the dispenser reaches a height so as to begin the siphoning action. U.S. Pat. No. 2,974,516 utilizes a control circuit for energizing solenoids to open and close valves at selected times during a cycle of operation to allow flow of additive into the clothes treatment area at those times.

SUMMARY OF THE INVENTION

A domestic laundry appliance is provided with an opening in a front panel thereof in which a bezel is mounted. The bezel has receptacles therein for receiving studs carried on a bin or container received in the bezel so that the bin can be tilted forward to a receiving position to extend out of the appliance. The bin has an open top so that when tilted forward a user has access to the interior of the bin. The bin is divided into a number of sections, one section for receiving a granular additive and other sections for receiving liquid laundry additives.

Each section for receiving a liquid additive has a siphon means therein including a tube extending upward into the section which is capped by a cylindrical cover with openings at a bottom thereof.

Each tube of each siphoning means communicates with a trough disposed in the appliance beneath the bin, as does the section for receiving granular additive.

When the bin is returned from the receiving position to a dispensing position in the interior of the appliance, each section of the bin is disposed beneath a solenoid operated diaphragm valve which selectively communicates the associated bin section with a water distribution path. Upon actuation of the solenoid operating a respective valve, water from the distribution path is allowed to flow through the section. In the bin sections containing the siphoning means, when the solution of water and liquid additive reaches a dispensing level above the top of the siphon tube, siphoning action begins to draw the entire liquid contents of the section out of the section and dispense same into the trough which communicates with a clothes treatment zone. Suitable control circuitry sequentially operates the solenoid valves to allow selective dispensing in proper sequence of the contents of each bin.

An overflow tube in each bin is movable with the bin to the receiving position to prevent filling of the bin beyond a level which would activate the siphoning action, and movable with the bin to the dispensing position to allow the liquid level in the bin to rise to the dispensing level.

DESCRIPTION OF THE DRAWINGS

FIG. 1 is a perspective view, partly broken away, of a horizontal axis laundry appliance embodying an automatic laundry additive dispenser.

FIG. 2 is a plan view partially in section and with parts broken away of the additive dispenser of FIG. 1.

FIG. 5 is a sectional view taken along line V—V of FIG. 3.

FIG. 7 is an alternate embodiment of a siphon usable in the granular additive bin in the dispenser of FIG. 6.

DESCRIPTION OF THE PREFERRED EMBODIMENTS

Figure 3:
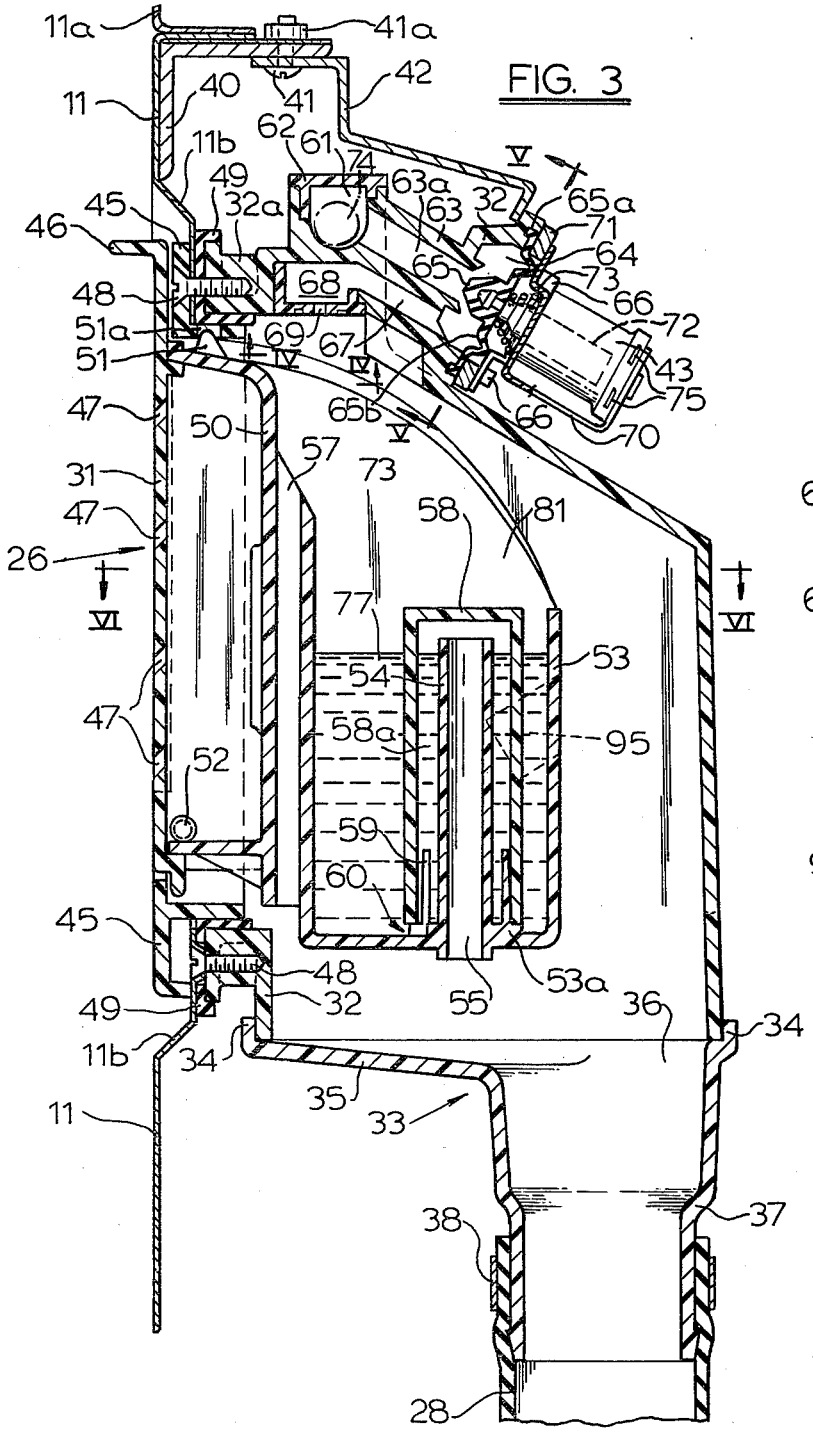
FIG. 3 is a sectional view of the additive dispenser of FIG. 2 in a dispensing position taken along line III—III of FIG. 2.

While the dispenser mechanism of the present application is of general utility, an exemplary application thereof is made for purposes of this disclosure to a horizontal axis laundry appliance shown generally at 10 in FIG. 1. The appliance 10 consists of a cabinet 11 having a top 11*a* in which is housed a nonrotatable suspended horizontal tub 12 containing a rotatable perforate tub 13 for receiving clothes to be washed. The appliance 10 has a motor 14 for rotating the perforate tub 13 through a transmission 15 and a pulley 16. The suspended tub 12 is suspended by four springs 17 (only one shown) from cabinet 11, and is provided with dampeners 17*a*, one of which is visible in FIG. 1. The motor 14 also operates a pump 20 which communicates with an automatic laundry additive dispenser 26 and with the interior of the stationary tub 12.

The appliance 10 is provided with a control panel 21 having a user control knob 22 for operating a pre-settable sequential control device 23 which sequentially operates the appliance 10 through a cycle of operation including washing, rinsing and drying periods.

The cabinet 11 is further provided with a front door 24 to afford access to the interior of the perforate tub 13 for loading and removal of clothes to be washed. The door 24 may have a viewing glass 25 centrally disposed therein.

The automatic laundry additive dispenser 26 is mounted in the cabinet 11 and has a filter inlet hose 27, a filter outlet hose 27*a*, and a dispenser outlet hose 28 connected thereto. The inlet hose 27 receives wash liquid which is continuously circulated through the filter and dispenser 26 by the pump 20. The dispenser 26 has an additive access door 31 and a filter access door 30. As will be more fully described below, wash liquid is continuously circulated through the filter through the dispenser 26 and returned to the tub 12, with the control device 23 selectively allowing mixing of the wash liquid with laundry additive in the dispenser 26 at appropriate times during a cycle of operation. The outlet hose 28 communicates with the stationary tub 12 to return dispensed liquid thereto.

The details of the laundry additive dispenser 26 are shown in FIGS. 2, 3, 4, 6 and 8. The dispenser 26 is shown in a dispensing position in FIG. 3. The dispenser comprises a housing 32 having an open lower portion to which is attached a collector 33. The collector 33 has a flanged rim 34 around the top thereof for receiving the housing 32. When so received, the housing 32 and the collector 33 form a water-tight unit. The collector 33 has a sloping surface 35 for directing liquid to an opening 36 communicating with a tube 37 to which the outlet hose 28 is attached by a clamp 38 or any other suitable means.

Figure 8:
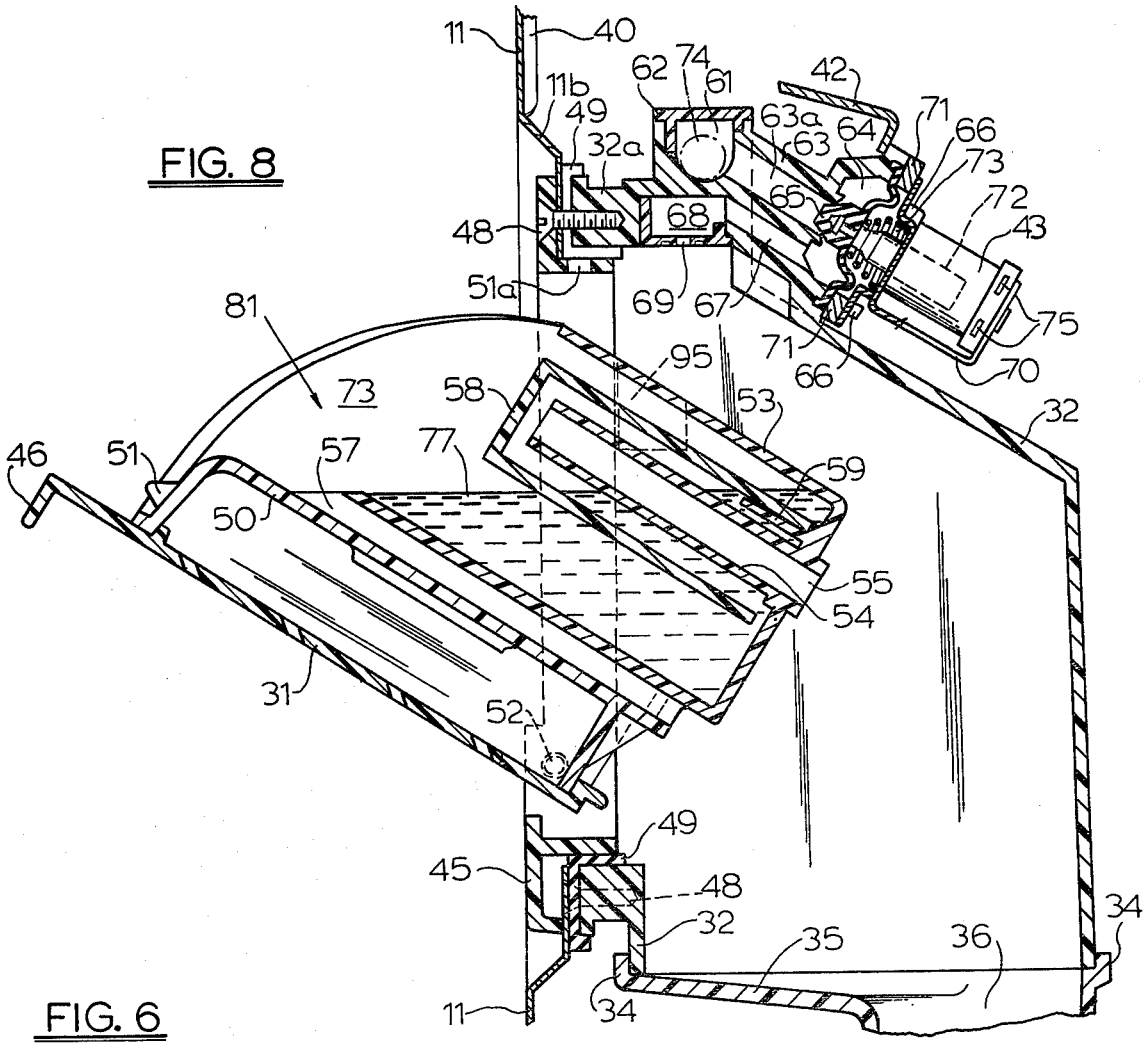
FIG. 8 is a sectional view of the bleach dispenser of FIG. 3 in a receiving position.
Figure 6:
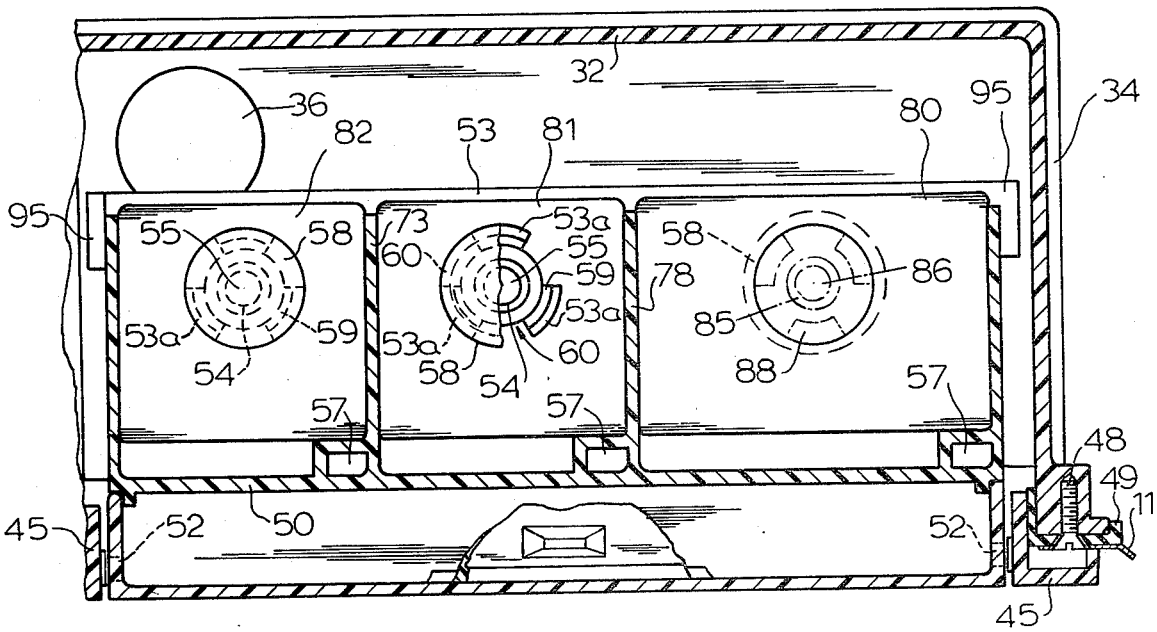
FIG. 6 is a sectional view taken along line VI—VI of FIG. 3.

As further shown in FIG. 3, the housing 32 is supported by a mounting means or frame 45 which is attached to the cabinet 11 by means of a plurality of screws 48, which also retain a sealing gasket 49. The cabinet 11 is indented to form a recess 11*b* for receiving the frame 45. As shown in FIGS. 3 and 6, the frame 45 receives pivot lugs 52 which pivotally support a container 53 in the interior of the housing 32. The container 53 has a handle 46 and is pivotable about the lugs 52 from the dispensing position shown in FIG. 3 to a receiving or tilted position shown in FIG. 8 wherein a front wall 50 of the container forms an angle with the frame 45. As shown in FIGS. 6 and 8, a pair of stops 95, formed on opposite sides of the container 53, limit rotation of the container 53 about the lugs 52 by contacting the frame 45 as the container is moved to the tilted receiving position shown in FIG. 8. The container 53 carries a detent 51 which is received in a groove 51*a* formed in frame 45 to retain the container 53 in the dispensing position shown in FIG. 3.

As shown in FIG. 6, the container 53 has parallel interior walls 73 and 78 which divide the container into compartments 80, 81 and 82. It will be understood that the container 53 may be divided into any number of such compartments without departing from the inventive concept herein.

With reference to FIGS. 3 and 6, a detailed description follows of the structure of the compartment 81, which is intended for dispensing a liquid laundry additive such as liquid detergent, bleach, or water softener. A siphoning means is provided in the compartment 81 consisting of a vertical tube 54 having a bore 55 therein which is integrally formed on the base of the container 53. Also formed on the base of the container 53 are spaced vertical members 59. The tube 54 and the vertical members 59 are covered by a cylindrical cap 58 which is received on segmented annular lands 53*a*. The cap 58 and lands 53*a* define openings 60 at the base of cap 58 for the passage of liquid. When liquid is present in the container 53 at a level above the top of the tube 54, siphoning action will begin with the liquid being drawn from container 53 through openings 60, through an interior annular channel 58*a* and out through bore 55 to the collector 33 where it will be transported to tub 12 through hose 28. Such siphoning action is selectively controlled as follows.

As shown in FIGS. 2 and 3, the dispenser 26 is provided with solenoids 43 and 44 at an upper portion thereof. Although the operation of the solenoid 43 will be described in connection with FIG. 3, it will be understood that operation of the solenoid 44 proceeds in identical fashion. Referring again to FIG. 3, the cabinet 11 is held against an angle bracket 40 along with the top 11*a* by a bolt 41 and nut 41*a*. The bolt 41 also retains a bracket 42 which supports a portion of the housing 32 cooperating with the solenoid 43. A water distribution channel 61 is formed by a trough in the housing 32 and is covered by a cover plate 62. Water enters the water distribution channel 61 from the filter (not shown) through opening 76 and exits the channel through an outlet 74 to hose 27*a* retained on a nipple 74*a*.

The water distribution channel 61 communicates with a connecting member 63 having a cylindrical bore 63*a* therein to allow flow of water from the water distribution channel 61 to a chamber 64 contained in the connection element 63. Flow of water is normally blocked, however, by a conventional diaphragm valve 65. The valve 65 is comprised of a flexible material and is retained against housing 32 at its edges 65*a* by an annular member 71. The diaphgram 65 is movable by a solenoid plunger 72 which is normally biased by a spring 73 to close bore 63*a*. Upon energizing the solenoid 43, the plunger 72 moves to overcome the spring bias and open the valve 65 to allow liquid flow to an annular chamber 64.

Figure 4:
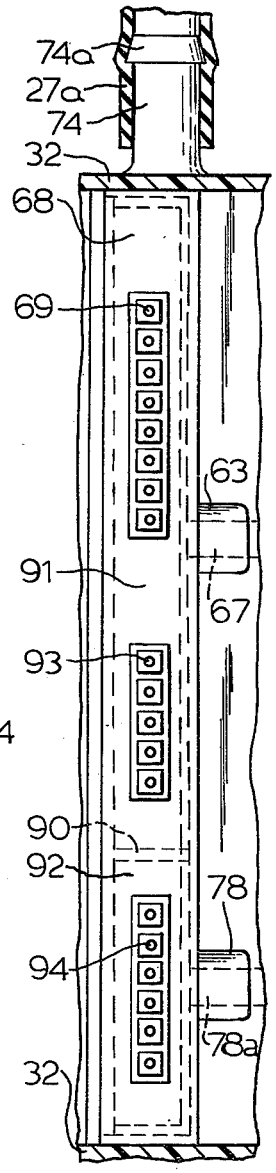
FIG. 4 is a sectional view taken along line IV—IV of FIG. 3.

When the solenoid 43 is thus energized, liquid flow is permitted through the channel 63*a* through the chamber 64 and into a second bore 67, as also shown in FIG. 5, to a channel 68 which extends along the length of the dispenser 26. As shown in FIG. 4, the channel 68 is provided with a vertical wall 90 to divide the channel 68 into two independent segments 91 and 92. In the embodiment shown in FIG. 4, the containers 80 and 81 are to be filled with liquid simultaneously, for which a plurality of apertures 69 are disposed above the container 80 and a plurality of apertures 93 are disposed above the container 81. The use of a plurality of small apertures 69 and 93, rather than a single large aperture for each compartment assures that water flowing segment 91 of channel 68 will reach the entire length of the segment and thus provide good distribution of water across each of the compartments. This is important particularly when a dry detergent is to be dispensed to insure a cleaning of the compartment.

At a different time during a cycle of operation, the solenoid 44 will be energized to allow liquid flow through a connecting member 78 having a bore 78*a* similar to bore 67 therein to the segment 92 and flow will occur through apertures 94 into the compartment 82.

Each solenoid is supported on a coil supporting bracket 70 and has spade terminals 75 thereon connected electrically to the control device 23 for sequential energization of the solenoids as hereinafter described.

As shown in FIG. 8, each compartment is provided with an overflow tube 57 formed adjacent an interior wall 50 in the container 53. The overflow tube 57 is positioned so as to prevent filling of any one of the compartments with a level of liquid 77 which would exceed the height of the siphon tube 54 when the container 53 is in either the receiving position shown in FIG. 8 or returned to the dispensing position shown in FIG. 3. Any liquid 77 added to compartment 81 above the level shown in FIG. 8 will flow down overflow tube 57 into collector 33. Thus a maximum amount of liquid additive that can be received in the container 81 is established by the combined overflow tube and tilting movement of the siphoned container. This prevents premature siphoning of the liquid out of any of the compartments and assures that a minimum amount of wash liquid will be added to the additive in the compartments 80, 81 and 82 before the liquid is dispensed to the tub 12.

Operation of the dispenser is as follows. Before a laundry cycle of operation is begun, a user tilts the container 53 forward, away from the cabinet 11 to the receiving position as shown in FIG. 8. A liquid laundry additive 77 is poured into one of the compartments 81 or 82 containing a siphon means. The compartment 80 is normally equipped for dispensing granular laundry additive and therefore does not have a siphon means therein. An attachable siphon means as shown in FIG. 7 will be described in detail below by the use of which all compartments 80, 81 and 82 can be adapted to accommodate liquid laundry additives. As an example, the compartment 80 may be filled with granular detergent, the compartment 81 may be filled with liquid bleach, and the compartment 82 may be filled with liquid fabric softener. With this combination of additives, it is desirable that the detergent and bleach contained respectively in the compartments 80 and 81 be entered into the stationary tub 12 during an early wash portion of the cycle of operation. The fabric softener should be added at a later rinse portion of the cycle.

The container 53 is then returned to the position shown in FIG. 3. The liquid received in container 58 assumes a level below the level of the siphon as shown. The user then operates the control dial 22 to begin a cycle of operation. During such operation, wash liquid is continually flowing through the water distribution channel 61 in the dispenser 26, but does not communicate with the additives in the container 53 because the diaphragm valves are closed by solenoids 43 and 44. Such circulation simply passes the liquid through the channel 61 to the outlet 74 for passage to the tub 12 through hose 27*a*.

At a selected time during the cycle of operation, the control device 23 emits a signal to energize the solenoid 43, thereby opening the diaphragm valve 65 and allowing water flow through the channel 63*a*, the chamber 64, the channel 67, the channel 68 and the apertures 69 and 93. The water level will thus begin to rise in each of the compartments 80 and 81. If the compartment 80 is not provided with an attachable siphon shown in FIG. 7, the water will mix with the granular additive, flow through a hole 80*a* in a base of the compartment 80 and be transported to the stationary tub 12. In compartment 81, the addition of water will cause the liquid level therein to rise to a dispensing level above the height of the siphon tube 54, thereby initiating a siphoning action through tube 55. Siphoning from compartment 81 will continue until valve 65 is closed by de-energization of solenoid 43 and the compartment 81 is completely emptied of liquid.

At a later time during a cycle of operation, the solenoid 44 will be energized for a period of time by the control device 23 allowing flow of liquid into the compartment 82 in which siphoning will be achieved to empty that compartment of the additive formerly contained therein.

If it is desired to equip the compartment 80 with a siphon means, the hole 80*a* therein can be plugged with a siphon tube 85 having a lower portion 84 received in the hole 80*a* as shown in FIG. 7. A grommet 83 maintains a water-tight relation between the container 53 and the tube 85. The tube 85 has carried on an exterior thereof vertical members 87 which operate in identical manner to the vertical members 59 integrally formed in the other compartments in the container 53. A cap 58, identical to those utilized in compartments 81 and 82 is fitted on a segmented land 84*a* to define openings 88 and an interior annular channel 85*a*. When the liquid level in the container 80 reaches a height greater than the siphon tube 85, siphoning action will occur through the openings 88, the channel 85*a*, a bore 86 in the tube 85 and out through the opening 80*a*.

Although modifications and changes may be suggested by those skilled in the art, it is the intention of the inventors to embody within the patent warranted hereon all changes and modifications as reasonably and properly come within the scope of their contribution to the art.

The embodiments of the invention in which an exclusive property or privilege is claimed are defined as follows:

1. In an automatic washer having a tub for receiving a clothes load to be washed and a water supply for delivering water to said tub, a dispenser for delivering an additive to said tub, said dispenser comprising:

a container for receiving and dispensing said additive;

a mounting means for pivotally supporting said container for movement between a receiving position and a dispensing position;

at least one siphon within said container communicating with said tub for siphoning a liquid from said container to said tub whenever said liquid rises above a dispensing level in said container;

an overflow tube within said container, said overflow tube movable with said container to said receiving position and when in said receiving position, effective to prevent filling said container to said dispensing level, said overflow tube movable with said container to said dispensing position and when in said dispensing position, effective to allow said liquid to rise above said dispensing level; and a valve means for directing a portion of said water supply to said container for mixing with said additive to raise the liquid level within said container above said dispensing level.

2. The dispenser of claim 1 wherein said container is divided into a plurality of noncommunicating compartments for receiving a plurality of different additives in respective compartments.

3. The dispenser of claim 1 wherein said container is divided into three noncommunicating compartments and wherein two of said compartments contain a siphon for dispensing liquid additive and wherein one of said compartments has an opening in a bottom thereof for dispensing a mixture of said water and a granular additive.

4. The dispenser of claim 3 wherein said valve means directs a portion of said water supply simultaneously to one of said compartments containing a siphon and said granular additive dispensing compartment at a first time in a cycle of operation, and directs a portion of said inlet water supply to the other of said compartments containing a siphon at a second time in said cycle of operation.

5. The dispenser of claim 1 wherein said valve means comprises at least one solenoid-controlled diaphragm valve.

6. The dispenser of claim 1 wherein said automatic washer has a cabinet having vertical walls, said mounting means is disposed in one of said vertical walls and said container has a front face, wherein said container is in said receiving position when said front face is in a tilted position with said container front face forming an angle with the wall in which said mounting means is disposed.

7. The dispenser of claim 1 wherein said automatic washer has a cabinet having vertical walls, said mounting means is disposed in one of said vertical walls, and said container has a front face, wherein said container is in said dispensing position when said front face of said container is coplanar with the vertical wall in which said mounting means is disposed.

8. In an automatic washer appliance having a treatment zone operable through a programmed sequence of washing, rinsing and drying steps, additive dispensing means in said appliance comprising a container adapted to be filed to selective levels, mounting means carrying said container for pivotal movement between a first receiving position and a second dispensing position, whereby the container may be charged with additive in said receiving position, siphon means in said container for siphoning liquid out of said container and into a treatment zone in response to the liquid in the container reaching a specified level, means for preventing said liquid from reaching said specified level when said container is in said first receiving position, and water control means for selectively providing water to said container and operable in correlation with the programmed sequence, whereby the container may be prefilled to a first selected level with additive and thereafter will be automatically filled to said specified level with water as a function of the programmed sequence of the machine whereupon the additive and water will be siphoned into the treatment zone.

9. For use with a domestic cleaning appliance having a treatment zone, an additive dispenser having a tiltable bin pivotally mounted for user access and partitioned to provide plural compartments for plural additives, presettable sequential control means including water control means actuable during the course of a programmed sequence of washing, rinsing and drying steps to direct a flow of water into at least one of said compartments in selected program sequence, a siphon means contained within at least one of said compartments for siphoning liquid from said compartments, each said siphon means being responsive to attainment of a dispensing water level in said compartment to automatically siphon the additive and water contents of such compartment into said treatment zone, and an overflow tube contained within each of said plurality of compartments to prevent a siphoning action by said siphoning means before said control means directs said flow of water into said compartment.

* * * * *